US007204171B2

(12) United States Patent
Yeager

(10) Patent No.: US 7,204,171 B2
(45) Date of Patent: Apr. 17, 2007

(54) APPARATUS FOR FASTENING AND LOOSENING A LID FROM A CONTAINER

(75) Inventor: Arthur F. Yeager, Columbia, SC (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 41 days.

(21) Appl. No.: 11/133,444

(22) Filed: May 20, 2005

(65) Prior Publication Data

US 2005/0257646 A1 Nov. 24, 2005

Related U.S. Application Data

(60) Provisional application No. 60/572,476, filed on May 20, 2004.

(51) Int. Cl.
*B67B 7/14* (2006.01)
*B67B 7/84* (2006.01)
*B67B 3/20* (2006.01)

(52) U.S. Cl. ..... 81/3.33; 81/3.37

(58) Field of Classification Search ..... 81/3.32, 81/3.33, 3.37, 3.29

See application file for complete search history.

(56) References Cited

U.S. PATENT DOCUMENTS

| | | | | |
|---|---|---|---|---|
| 80,583 | A | 8/1868 | Allard | |
| 352,659 | A | 11/1886 | Petersen | |
| 1,365,405 | A * | 1/1921 | Howard | 30/433 |
| 1,821,194 | A | 9/1931 | Wilcox | |
| 3,159,064 | A | 12/1964 | Woloszyn | |
| 3,812,742 | A | 5/1974 | Polasek | |
| 3,971,188 | A | 7/1976 | Cawrse | |
| 4,358,970 | A | 11/1982 | Jacobson | |
| 4,569,281 | A | 2/1986 | Woods | |
| D286,734 | S | 11/1986 | Furman | |
| 4,852,431 | A | 8/1989 | Frangel | |
| 5,054,266 | A | 10/1991 | Mello et al. | |
| 5,165,310 | A | 11/1992 | Heinrich | |
| 6,263,761 | B1 | 7/2001 | Ryder | |
| 6,651,531 | B1 | 11/2003 | Thornton | |
| 7,024,965 | B2 * | 4/2006 | Tremblay | 81/3.2 |
| 2005/0132845 | A1 | 6/2005 | Chervak et al. | |

FOREIGN PATENT DOCUMENTS

| | | |
|---|---|---|
| WO | WO 88/03510 | 5/1988 |

OTHER PUBLICATIONS

Amazon.com, Black & Decker Lids off Jar Opener, printed on Sep. 28, 2004 from www.amazon.com, p. 1.
Bed Bath & Beyond, Black & Decker Lids Off Automatic Jar Opener, printed on May 7, 2004 from www.bedbathandbeyond.com, p. 1 with enlarged image attached.
Jermanco, Jaromatic Automatic Jar Opener, printed on Sep. 28, 2004 from www.jaromatic.com, pp. 1-2.
Linens-N-Things, Under Cover Sale Booklet, , May 2004, p. 5.
The Home Marketplace, Black & Decker Lids Off Jar Opener, printed on Sep. 28, 2004 from www.thehomemarketplace.com, p. 1.

* cited by examiner

*Primary Examiner*—David B. Thomas
(74) *Attorney, Agent, or Firm*—Elizabeth Arwine

(57) ABSTRACT

The device performs the function of opening and/or closing lids attached to containers, and more particularly child-proof lids in at least some embodiments. The device preferably includes a base, a post, an arm, a mechanism that converts straight movement to rotation movement, and a plate to engage the lid of a container. The conversion mechanism in at least some embodiments includes a spring.

20 Claims, 12 Drawing Sheets

166
164
162
166

144
168

150
153
154
158
1582
1441

150
142
1441
144
156
1444
154

142
1422
142

122
1444
1441
154
156
146
142
144
142
1422
132
1446
120
110

APPARATUS FOR FASTENING AND LOOSENING A LID FROM A CONTAINER

This patent application claims the benefit of U.S. Provisional Patent Application No. 60/572,476, filed May 20, 2004, which is hereby incorporated by reference.

I. FIELD OF THE INVENTION

The present invention relates generally to devices for securing and unsecuring lids from containers, and more specifically, a device for tightening and loosening child-resistant lids from pill containers.

II. BACKGROUND OF THE INVENTION

Medical conditions such as Thoracic Outlet Syndrome and Carpal Tunnel Syndrome are sometimes grouped together under the name Cumulative Trauma Disorder (CTD) or Repetitive Stress Injury (RSI). These conditions are often caused by repetitive movements or motions. For example, data entry personnel often experience Carpal Tunnel Syndrome due to the constant and repetitive motions performed by their fingers depressing keys on a keyboard. Medical professionals such as pharmacists and nurses sometimes experience similar medical ailments due to repetitively placing lids or covers on pill bottle containers, for example. Due to the aforementioned conditions and other medical conditions (for example, arthritis, bursitis, and tendonitis), engaging in simple day-to-day activities such as placing the cover on a pill bottle can become challenging to some affected individuals.

For example, many senior citizens suffer from medical ailments such as inflammation of the joints of the fingers. As a result, these individuals are sometimes required to consume medication to assist in treating the ailments. Ironically, however, some of the individuals experience so much pain or discomfort from the ailments that they cannot open containers including their medication bottles. Handicapped individuals sometimes experience a similar problem. For example, hand or arm amputees with one real hand and possibly a prosthetic hand sometimes struggle to hold a pill bottle with their prosthetic, as they attempt to twist the lid off of the pill container with their good hand. Such a struggle may result in frustration and discouragement from consuming medication.

Child proof medicine bottles have lids that only need to be turned a little ways once depressed, but this is a different task for individuals with limited hand strength and dexterity and nearly impossible for certain C-spine injuries or stroke victims. Use of an electric powered device to open these containers would be overkill and potentially lead to an injury of the user if the lid (or cap) was turned too much while the user was holding the container resulting in the container being twisted out of the user's grasp. Additionally, electric powered devices are primarily used to perform multiple rotations during each activation, which is in excess of the minimal little turn of the cap needed to open a child proof medicine bottle.

Notwithstanding the usefulness of the above-described methods, a need still exists for a simple hand powered apparatus for easily loosening and fastening lids on containers, in particular child proof lids on medicine bottles.

III. SUMMARY OF THE INVENTION

Illustrative, non-limiting embodiments of the present invention overcome the aforementioned and other disadvantages associated with opening and closing child-proof containers. Also, the present invention is not required to overcome the disadvantages described above and an illustrative non-limiting embodiment of the present invention may not overcome any of the problems described above.

According to at least one embodiment of the invention, the invention includes a device for loosening and/or tightening a lid onto a container, the device including: a base, a post connected to the base, an arm connected to the post, a lever in rotational communication with the arm, a head, and a rotating means for rotating the head based on movement of the lever. At least one further embodiment provides for the rotating means to include an outer shaft linear engagement of the gear, an inner shaft in communication with the outer shaft, and a spring in communication with the inner shaft and the head. At least one further embodiment provides for the following: the lever to include a handle and a roller having a spindle connected to the handle and the arm; the head to include a top plate connected to the roller, a bottom plate, the bottom plate having a plurality of recesses spaced around a perimeter of the bottom plate and a bottom surface capable of contacting a lid of a container, and a bearing between the top plate and the bottom plate; and the rotating means to include at least two paddles extending from the spindle and spaced from each other, each of the paddles is capable of engaging at least one recess in the bottom plate, and a post on an end of the roller, the post is capable of pushing at least one paddle. At least one further embodiment provides for the following: the arm to include a passageway passing therethrough; the lever to include a handle and a cam end connected to the handle and the arm; and the rotating means to include a spindle passing through the passageway of the arm, a spring encircling a portion of the spindle above the arm, a cam follower attached to the spindle at a point below the arm, the cam follower in communication with the cam end of the lever, and a cam wedge connected to the head, the cam wedge capable of causing the head to rotate as the handle traverses the cam wedge.

According to at least one embodiment of the invention, the invention includes a device for loosening and/or tightening a lid onto a container, the device including: a base, a post connected to the base, an arm connected to the post, the arm including a sleeve, a lever in rotational communication with the arm, a gear connected to the lever and housed within the arm, an outer shaft including a rack engaging the gear and journaled with the sleeve, an inner shaft connected to the outer shaft, the inner shaft including a barrier internal to the inner shaft and a plurality of teeth around a bottom of the inner shaft, a spring in communication with the barrier and internal to the inner shaft, a head in communication with the spring, the head having a top surface, a plurality of teeth spaced from each other and extending from the top surface capable of engaging the plurality of teeth of the inner shaft, a post extending up from the top surface from a point within the plurality of teeth, the post encircled by the spring, and a bottom surface opposing the top surface.

According to at least one embodiment of the invention, the invention includes a device for loosening and/or tightening a lid onto a container, the device including: a base with at least one protrusion having a circular shape, a controlling means for controlling the operation of the device, a lid contacting means for contacting a lid of a container and rotating the lid, a rotational means for rotating the lid contacting means in response to use of the controlling means, a means for placing the rotational means over the base.

An objective of the invention is to allow individuals with certain physical limitations to independently open a child-proof medicine bottle (or container).

Given the following enabling description of the drawings, the apparatus should become evident to a person of ordinary skill in the art.

IV. BRIEF DESCRIPTION OF THE DRAWINGS

The aspects of the present invention will become more readily apparent by describing in detail illustrative, non-limiting embodiments thereof with reference to the accompanying drawings.

The use of cross-hatching within these drawings should not be interpreted as a limitation on the potential materials used for construction of the invention. Like reference numerals in the figures represent and refer to the same element or function.

V. DETAILED DESCRIPTION OF THE DRAWINGS

Figure 1B:
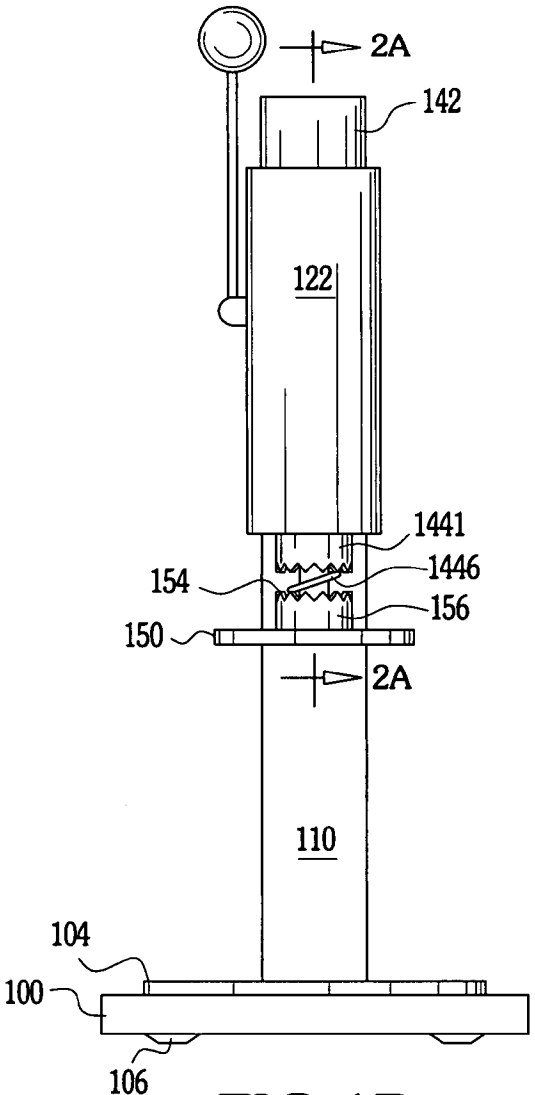
FIGS. 1A and 1B illustrate side views of an exemplary embodiment according to the invention.

Exemplary, non-limiting, embodiments of the present invention are discussed in detail below. While specific configurations are discussed to provide a clear understanding, it should be understood that the disclosed configurations are provided for illustration purposes only. A person of ordinary skill in the art will recognize that other configurations may be used without departing from the spirit and scope of the invention.

The invention in the illustrated exemplary embodiments includes a base on which a container sits and means for rotating a lid of the container. The rotating means includes an engagement head (or plate) connected to a lever (or handle) that is capable of causing the engagement head to rotate the lid relative to the container to either loosen (open) or tighten (close) the lid. In some of the embodiments the lever drives a shaft down to apply a force through the engagement head onto the lid prior to beginning to rotate the engagement head. In at least one embodiment, the engagement head is connected to (or includes) a wedge cam that translates vertical (or linear) movement of the lever into rotational movement of the engagement head. In at least one embodiment, the lever provides the rotational force through a spoke (or paddle) that engages the top of the engagement head.

FIGS. 1A–5 illustrate exemplary embodiments having a base 100, a post 110 extending up from the base 100, an arm 120 attached to the post 110 and extending over the base 100, a lever 130 connected to the arm 120, a drive system (or means for rotating the head based on movement of the lever) 140, and an engagement head 150 connected to the drive system 140.

Figure 1A:
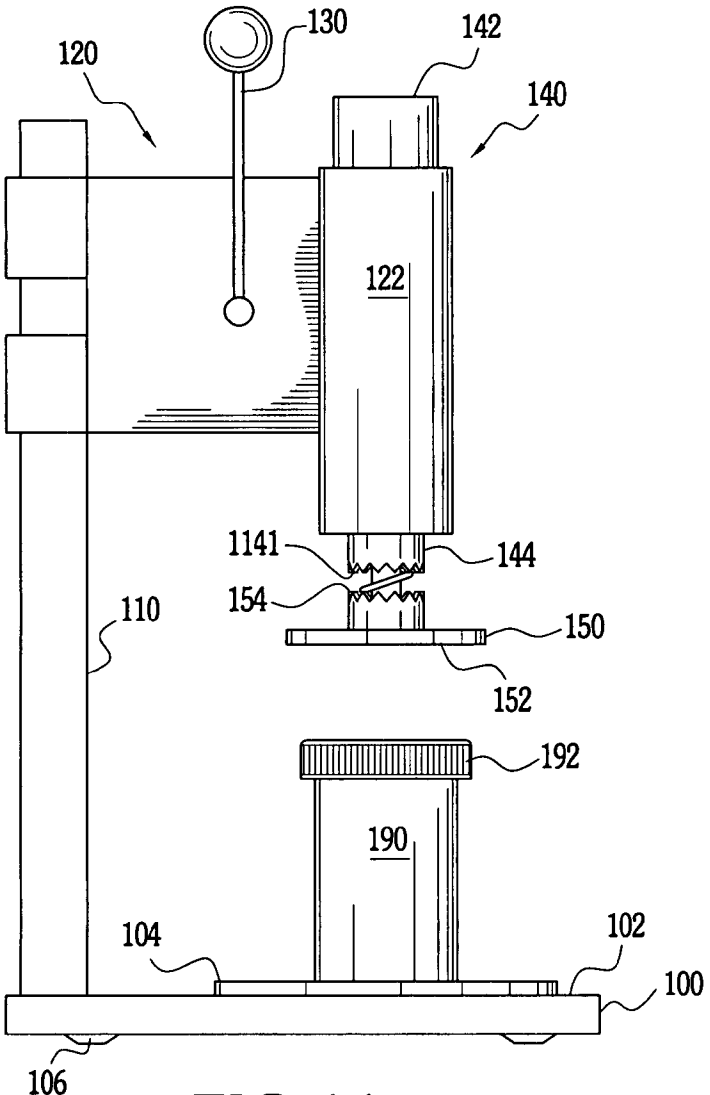
Figure 7A:
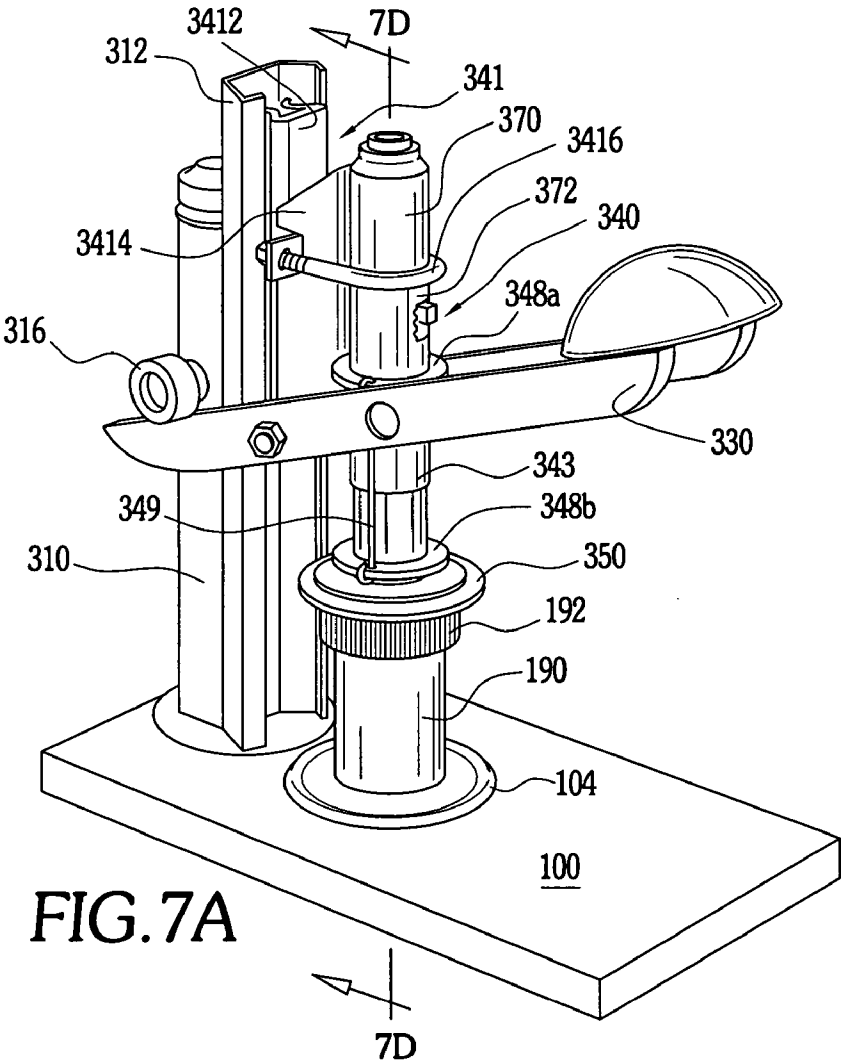
FIG. 7A illustrates a perspective view of an exemplary embodiment according to the invention.
Figure 8A:
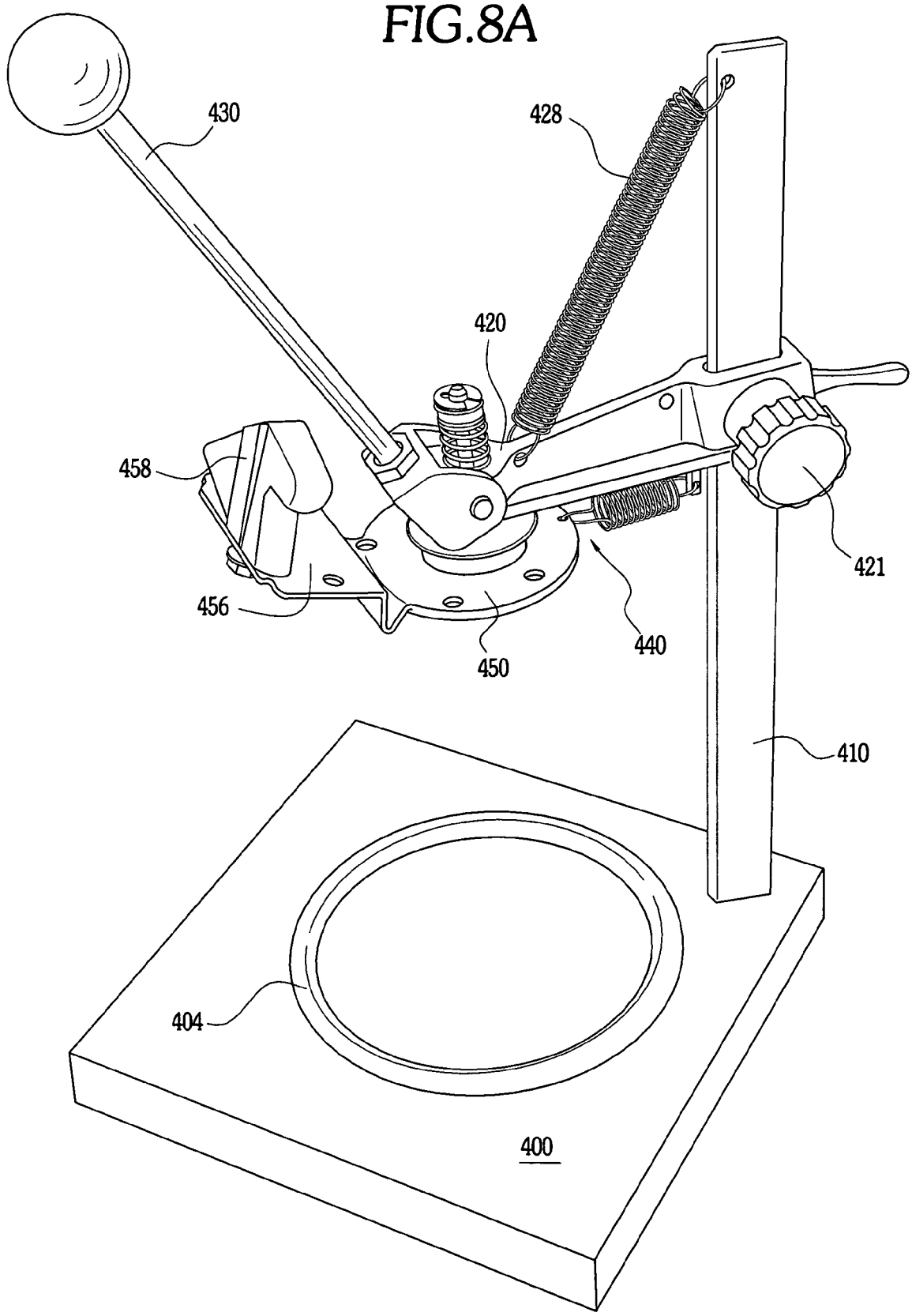
FIG. 8A illustrates a perspective view of an exemplary embodiment according to the invention.
Figure 8B:
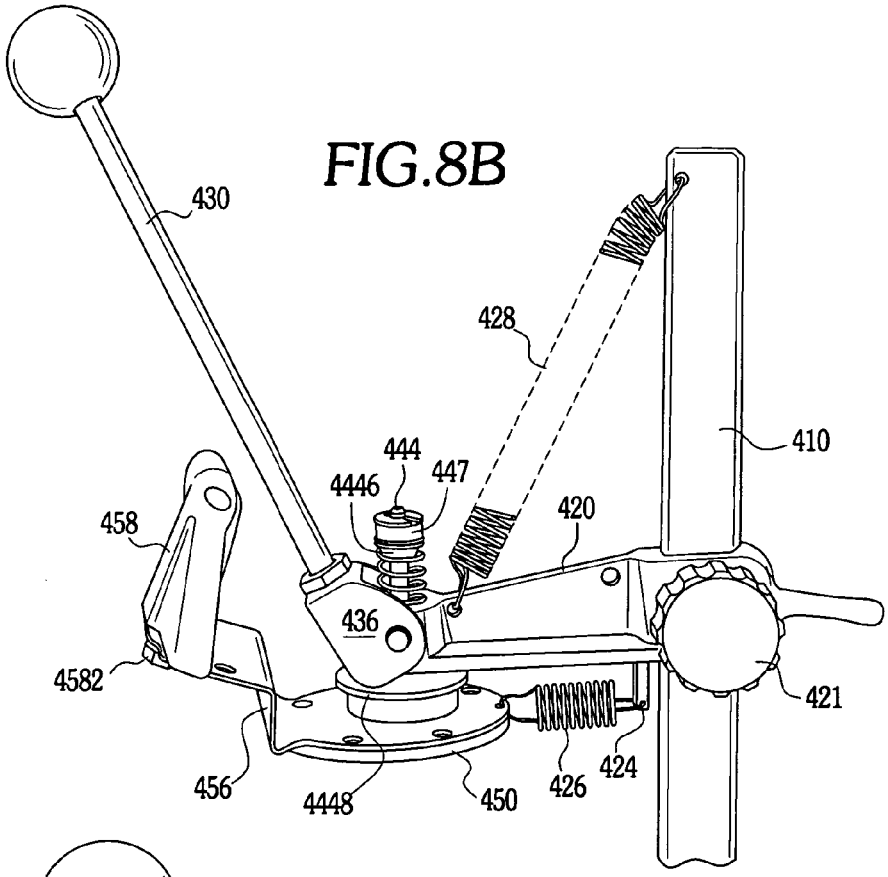
FIGS. 8B and 8C depict perspective views of the upper portion of the exemplary embodiment illustrated in FIG. 8A.
Figure 8C:
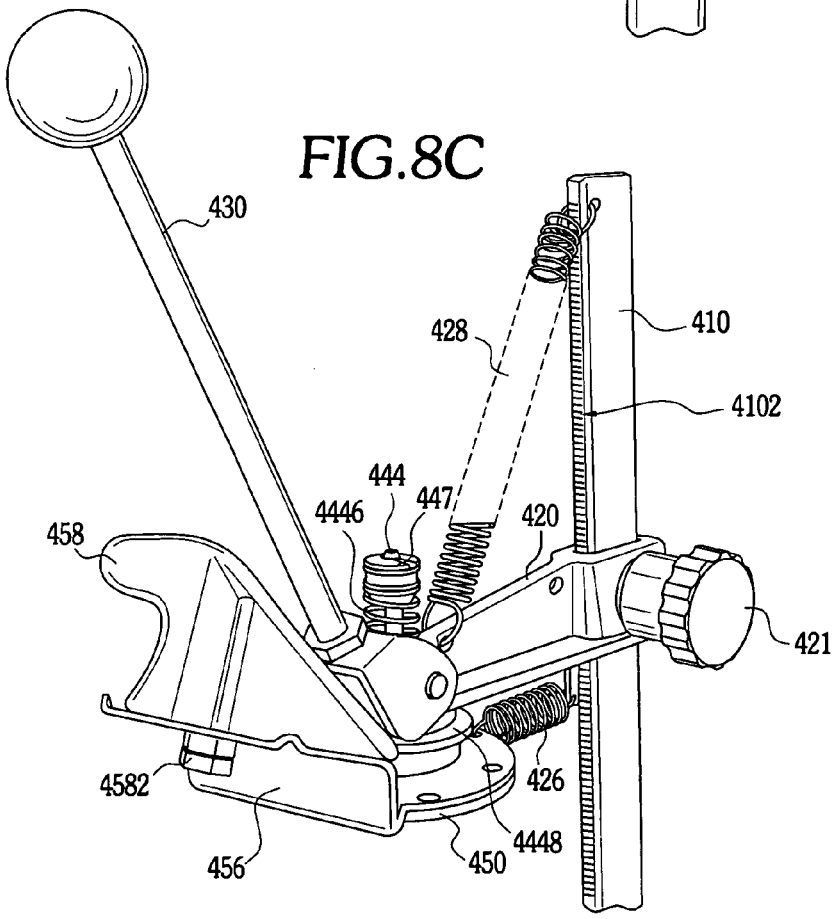

The base 100 preferably includes a top surface 102 on which the container is placed. The top surface 102 as illustrated includes a plurality of circular ridges (or protrusions) 104 (illustrated in, for example, FIG. 7A) sized to fit different typical sizes of medicine (or pill) containers 190. The area around the ridges 104 is preferably made of a material that is able to frictionally restrain the container during the opening and closing of the lid. An exemplary material is rubber, and more particularly Dycem™. The entire base 100 may be made of this material, the top surface 102 may be coated with this material, or just the area proximate the area defined by the ridges 104. The base 100 as illustrated includes a plurality of footings 106 to prevent sliding of the device across a work surface during use. Although, for example, FIGS. 1A and 1B illustrate the base 100 as rectangular, the base 100 may have any shape and any size that will provide stability for the device and allow for placement of a container 190 on it for opening/closing a lid 192. Exemplary shapes include the illustrated square shape in, for example, FIG. 8A; the illustrated circular shape in FIG. 10A; and other shapes such as oval, triangle, and other polygons.

The post 110 is connected to the base 100 and places the arm 120 above the work area, which allows placement of the container 190 below the engagement head 150. Although not illustrated in FIGS. 1-5, the arm in at least one embodiment could be height adjustable up and down the post.

The lever 130 is connected to a gear 132 that is internal to and housed within the arm 120. The arm 120 includes a sleeve 122 through which the drive system 140 passes. The sleeve 122 as illustrated in, for example, FIG. 2A includes a slot for the gear 132 to engage the drive system 140. As the lever 130 is rotated towards the user, the drive system 140 is lowered towards the lid 192 causing the drive system 140 to eventually rotate the engagement head 150 and lid 192 relative to the container 190.

Figures 2A, 2B, 3, 4, 5A, 5B:
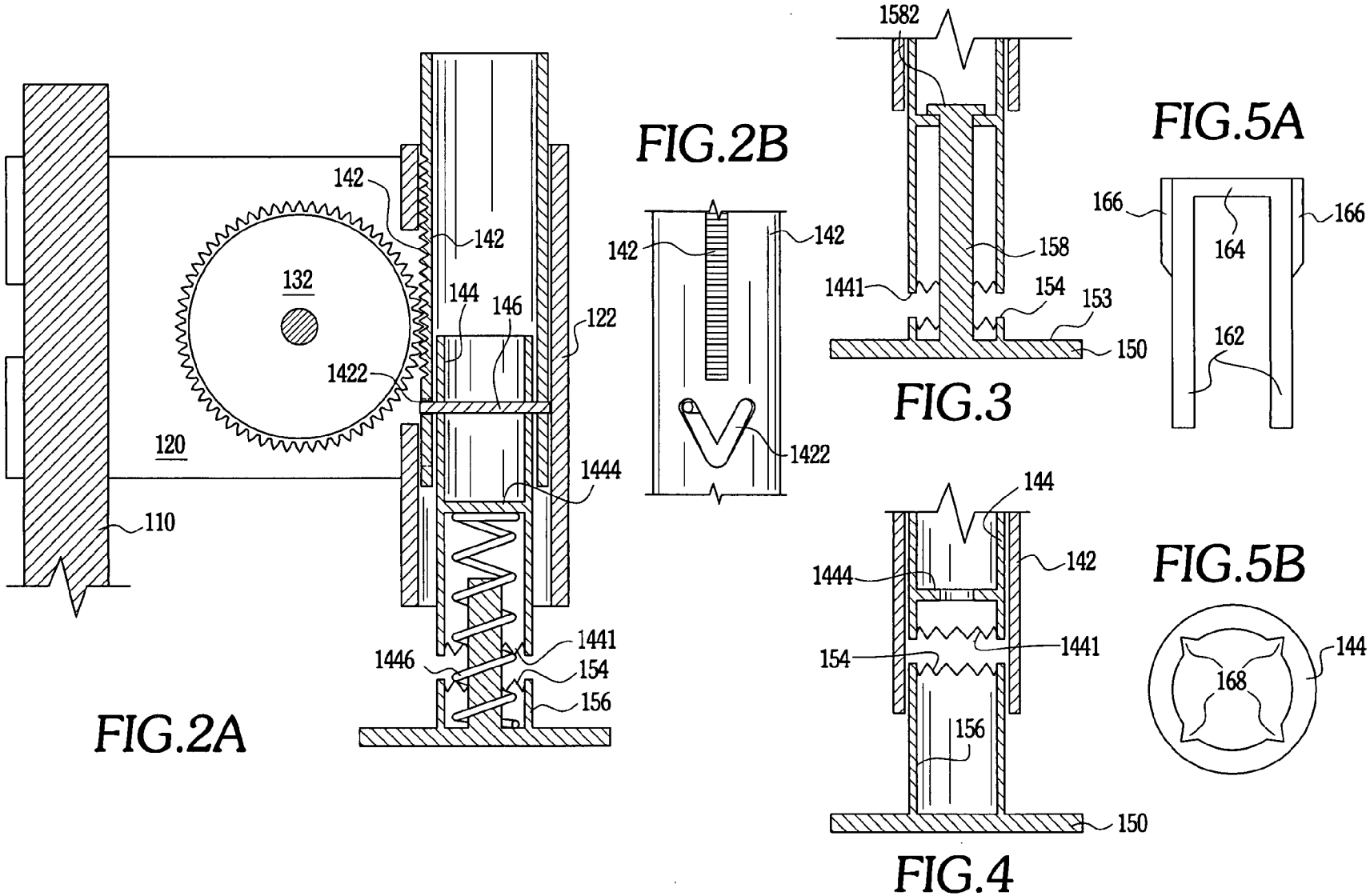
FIG. 2A depicts a cross-sectional view taken at 2A—2A in FIG. 1B of an upper portion of the exemplary embodiment shown in FIG. 1B.
FIG. 2B illustrates a side view of a portion of the outer shaft of the exemplary embodiment of FIGS. 1A–2A.
FIGS. 3 and 4 depict alternative arrangements of the shafts and engagement head of the exemplary embodiment of FIGS. 1A–2A.
FIG. 5A illustrates a side view of an alternative component for use with an alternative exemplary embodiment.
FIG. 5B depicts a top view of the inner shaft for use with the component illustrated in FIG. 5A.

FIGS. 2A and 2B illustrate an exemplary drive system 140 that includes an outer shaft 142 that includes a plurality of teeth 1421 as illustrated in, for example, FIG. 2B along its surface for engagement by the gear 132 in a rack and pinion configuration.

FIGS. 2A and 2B illustrate an inner shaft 144 being connected to the outer shaft 142 with a pin(s) 146 to convert lateral movement into rotational movement. Depending upon the arrangement there may be one pin 146 that transverses the diameter of the inner shaft 144 or a pair of pins 146 extending from opposing sides of the inner shaft 144. The inner shaft 144 is illustrated as being fixedly connected to the pin(s) 146. The pin(s) 146 slidingly engages V-shaped slots 1422 present on opposing surfaces of the outer shaft 144 as illustrated in, for example, FIGS. 2A and 2B. The V-shaped slots 1422 allow the device to open and close lids depending on which halves of the V-shaped slots 1422 are used. If the left side of the V-slot is used, then the lid will be closed from the container. If the right side of the V-slot is used, then the lid will be opened from the container. On the inside of the inner shaft 144 and at a point below the pin(s) 146, a barrier 1444 on which a spring (or other compression resistant mechanism) 1446 is mounted or in communication with. The spring 1446 also assists in resetting the device after use. This exemplary embodiment could further include a selector switch (not shown in FIGS. 2A and 2B) connected to a covering that would be slid over half of the V-slot to allow the user to select whether they wanted to loosen or fasten a lid to a container.

Alternatively, the outer shaft 142 can connect to the inner shaft 144 with a pin(s) 146 with a similar cross-section as that illustrated in FIG. 2A. The outer shaft 142 would preferably fixedly connect to the pin(s) 146. The pin(s) 146 would preferably slidingly engage V-shaped slots present on opposing surfaces of the inner shaft 144. The V-shaped slots would allow the device to open and close lids depending on which halves of the V-shaped slots are used.

Under either of the above described exemplary embodiments, the inner shaft 144 as illustrated includes a plurality of teeth (or other protrusions for gearing) 1441 around the bottom of the inner shaft 144 to engage reciprocating teeth (or other protrusions for gearing) 154 around the top of the engagement head 150. The engagement head 150 as illustrated includes a bottom surface 152 and a plurality of teeth 154 on its top. The various illustrated engagement heads in this disclosure preferably have a rubber surface or a Dycem™ surface to better grip and engage lids 192. Alternatively, the bottom of the engagement heads may have a socket (not shown) having a conical (or partially conically) interior lined with a gripping material like rubber or Dycem™ that would allow different size lids to be open by the device.

The plurality of teeth may be formed as illustrated, for example, in FIG. 3 (spring 1446 is omitted for clarity) on the top surface 153 of the engagement head 150 or in FIGS. 2A and 4 on the top of a shaft 156 extending up from the top surface 153 of the engagement head 150. FIG. 4 (spring 1446 is omitted for clarity) also illustrates an exemplary embodiment where the outer shaft 142 overlaps with the shaft 156 thus strengthening the engagement that occurs between the inner shaft 144 with engagement shaft 156 and covering the spring 1446. The engagement head 150 as illustrated in FIG. 3 includes a restraining post 158 extending up from the top surface 153 to restrain the spring 1446, which preferably is attached to the top surface 153; however, the post 158 may be omitted from the device. FIG. 3 illustrates the post extending up for a distance sufficient to overlap with the inner shaft 144, while FIG. 4 illustrates the post 158 extending up and through an opening in the barrier 1444 so that when the device is not engaging a container 190, the post 158 is able to hang from the barrier with top 1582.

FIG. 5A illustrates a selector apparatus (or switch mechanism or operation switch) for use with the exemplary embodiment with V-shaped slots on the inner shaft 144 that includes a pair of arcuate plates 162 depending from a dial 164 that allows the user to select whether the device should open or close a lid of a container. The selector switch engages the inside of the inner shaft 144 with a protrusion 166 such as a ridge or extended tooth and a reciprocating channel 168 shaped to engage the protrusion, while alternatively the protrusion may be present on the inside of the inner shaft 144 with the channels being present on the selector switch. As illustrated in FIG. 5A, the protrusion may be present on each of the arcuate plates for engagement of channels running down from the top of the inner shaft 144. As illustrated in FIG. 5B, there are two sets of channel pairs to allow the selector switch to switch between an open state and a close state.

The user sets the device for opening or closing a lid 192 of a container 190 and also places the container 190 onto the base 100 below the engagement head 150. The user pulls the handle 130 towards them and away from the post 110 to lower the drive system 140 and the engagement head 150 towards the lid 192. The spring 1446 begins to compress when the engagement head 150 contacts the lid 192 and pushes to a disengagement state from the container 190, i.e., the lid 192 is able to be rotated relative to the container 190. Once the teeth 1441, 154 of the inner shaft 144 and the engagement head 150 engage, additional lowering the handle 130 relative to the ground will result in the outer and inner shafts 142, 144 turning the vertical movement of the outer shaft 144 into rotation of the engagement head 150 and thus the lid 192.

Figure 6B:
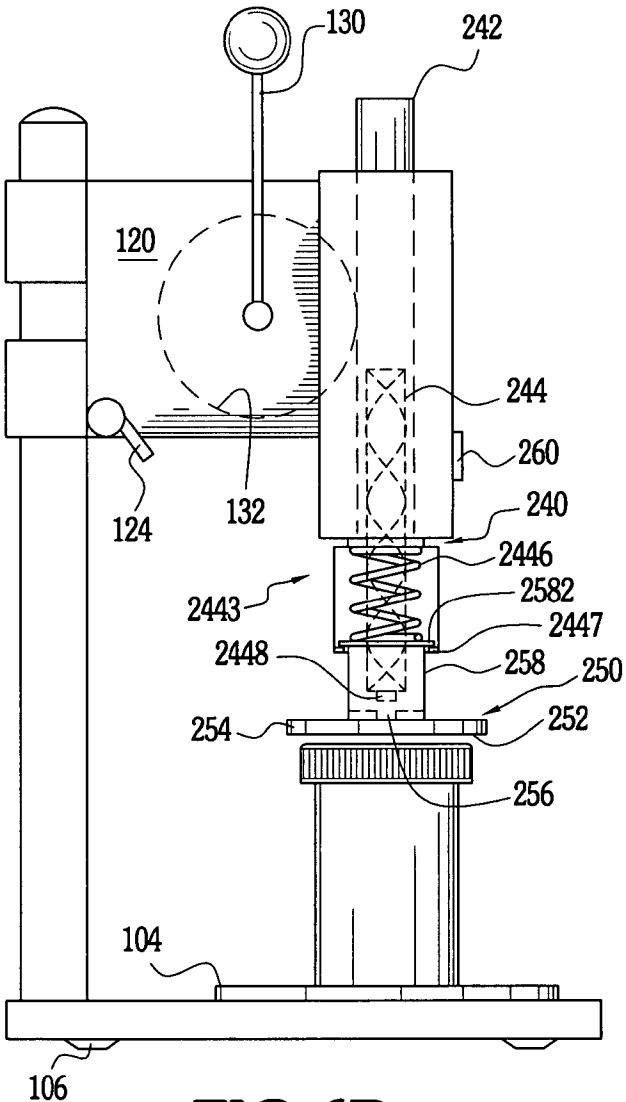
FIGS. 6B and 6C depict side views of the exemplary embodiment shown in FIG. 6A with internal components shown in phantom and a conceptual view of the interaction between a gear and an outer shaft. These figures illustrate operation of the exemplary embodiment.
Figure 6A:
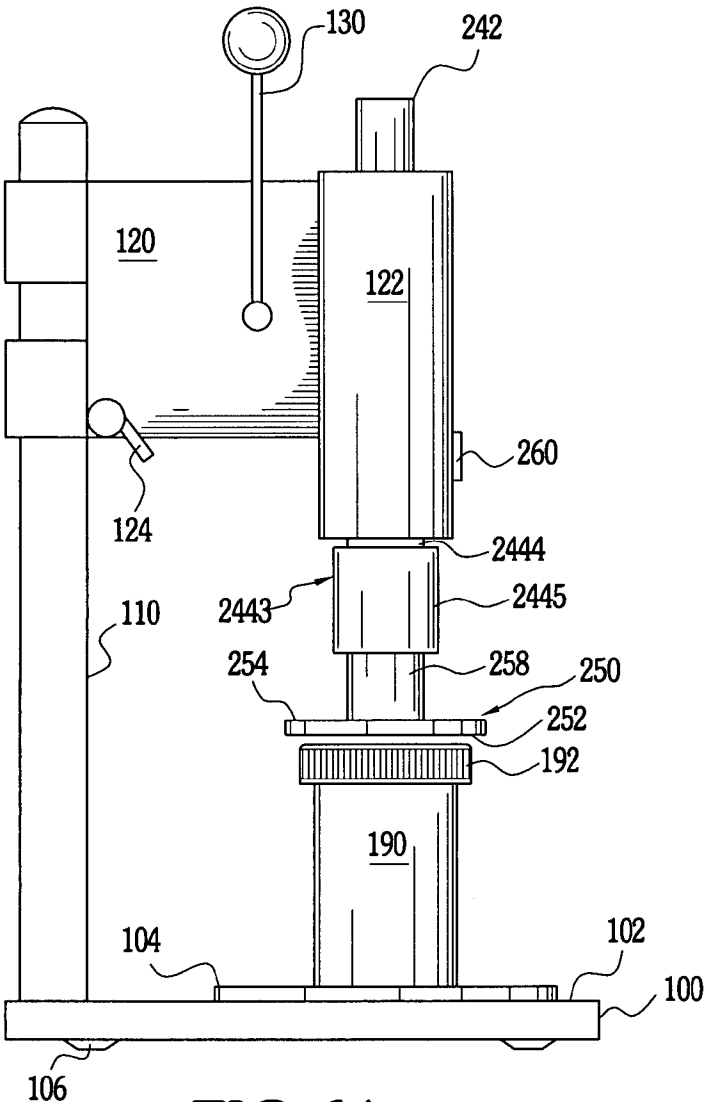
FIG. 6A illustrates a side view of an exemplary embodiment according to the invention.
Figure 6C:
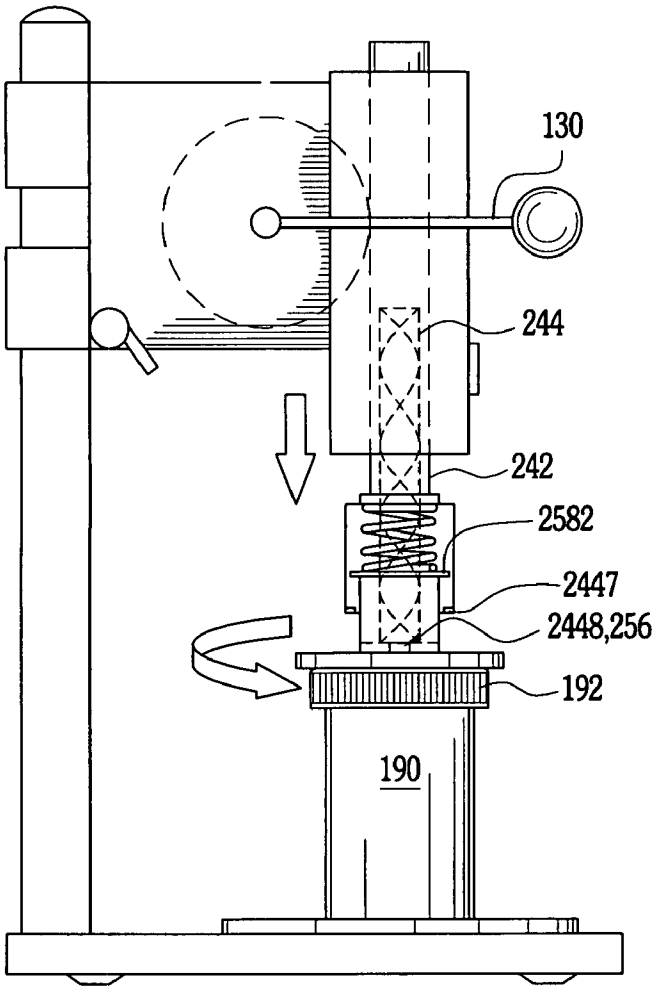

FIGS. 6A–6C illustrate another exemplary embodiment of the invention similar to the previous exemplary embodiment, but having a different structure for the drive system 240 and the engagement head 250. This illustrated embodiment also adds an adjustment lever 124 that locks in place the arm 120 relative to the post 110, which may also be incorporated into the exemplary embodiments shown in FIGS. 1A–5.

The drive system 140 includes an outer shaft 142 and a spindle (or inner shaft) 244 as illustrated in phantom in FIGS. 6B and 6C. The illustrated spindle 244 includes a socket 2443 and spiral grooves 2442 on the outside surface for engaging at least one pin(s) (or protrusion(s)) 246. Once the spindle 244 becomes engaged with the engagement head 250, any additional downward movement of the outer shaft 142 will cause the spindle 244 to rotate. The socket 2443 as illustrated includes a top (or barrier) 2444 connected to the spindle 244 and a cylindrical shaft 2445 depending from the top 2444. Attached to the top 2444 is a spring 2446 that encircles the portion of the spindle 244 present in the socket 2443. The cylindrical shaft 2445 as illustrated includes an internal rim 2447 around the bottom for restraining the engagement head 250. As illustrated, the spindle 244 includes a tip 2448.

The engagement head 250 includes a bottom surface 252, a top surface 254 having a groove (or channel or recess) 256, and a shaft 258 with a rim 2582 around its top for engaging the rim 2447. The top of the shaft 258 is in communication with the spring 2446. The groove 256 is engaged by the tip 2448 during use to apply the rotational force to open/close the lid.

Also illustrated in, for example, FIG. 6A, is an operation (or selector) switch 260 that allows the user to select whether they want to open or close the lid 192 on the particular container 190.

During use of the device, the user places the container 190 with the lid 192 below the engagement head 250 using, for example, the circular ridges 104 as a guide for centering the container 190. The user selects the desired operation with the operation switch 260. FIG. 6B illustrates the device in its start state. The user pulls the handle 130 towards them to rotate the gear 132 and move the outer shaft 142 down and as a result lower the engagement head 250 into contact with the lid 192. After the engagement head 250 contacts the lid 192, the spring 2446 is compressed as the engagement head 2448 is lowered into engagement with the groove 256 as illustrated in FIG. 6C. As further pressure is applied via the handle 130, the lid 192 will be pushed down on and disengaged from the container 190, which will allow the lid 192 to rotate relative to the container 190. At this point, as the handle 130 is pushed lower, the pin(s) 246 begin to travel along the spiraling grooves 2442 resulting in vertical movement of the handle 130 being translated into rotational movement of the tip 2448, which in turn rotates the engagement head 250 and the lid 192 as illustrated by the arrows present in FIG. 6C.

FIGS. 7A–7D illustrate another exemplary embodiment of the invention that includes a base 100, a post 310 with a slide track 312 attached thereto, a lever (or handle) 330, a drive system 340, and an engagement head 350. The post 310 as illustrated includes a pair of rollers 316 extending from either side of the post 310. The rollers 316 are in rolling contact with the lever 330. Although illustrated as being two separate components, post 314 and the slide track 312 may be formed together as a unitary piece.

The illustrated drive system 340 includes slide mechanism 341, a rotation driver mechanism 370, a telescoping shaft 343, a spring 2446, and a pair of washers 348 connected by a pair of strands 349. The slide mechanism 341 preferably is biased upwards, and an exemplary way to accomplish this is by having a spring present between the slide mechanism 341 and the slide track 312. The slide mechanism 341 includes a slide piece 3412, a spacer member 3414, and a bracket 3416. The slide mechanism 341 alternatively can be considered to be an arm 320, and separate from the drive system 340. For example in FIG. 7A, the rotation driver 370 is attached to the spacer member 3414 and the slide piece 3412 with bracket 3416; however, one of ordinary skill in the art will appreciate based on this disclosure that these elements could be combined in a variety of ways to, for example, reduce the number of separate components. The lever 330 attaches to the spacer member 3414 and slides about the rollers 316.

Figure 7D:
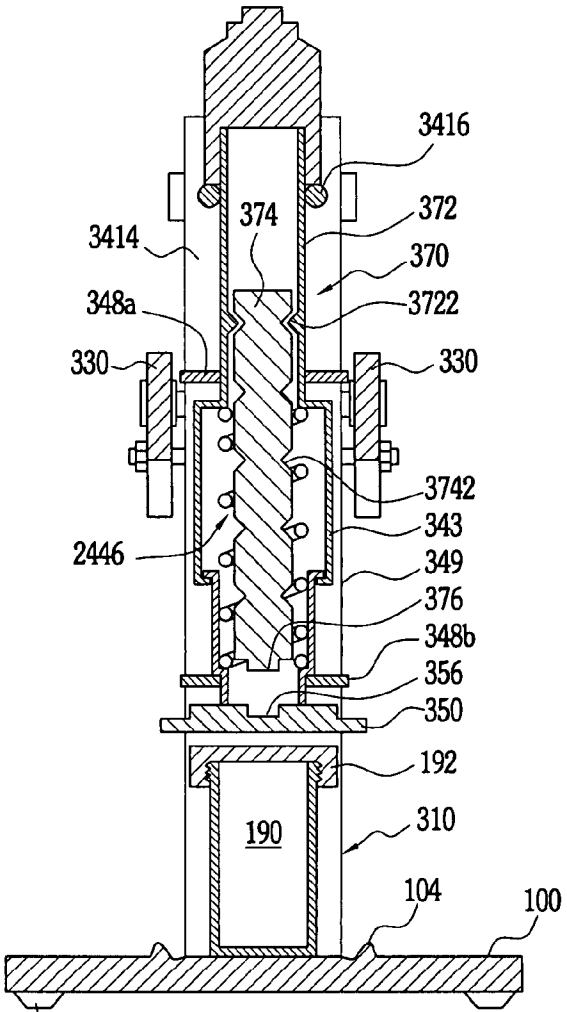
FIG. 7D depicts a cross-sectional view taken at 7D—7D in FIG. 7A.
Figure 7C:
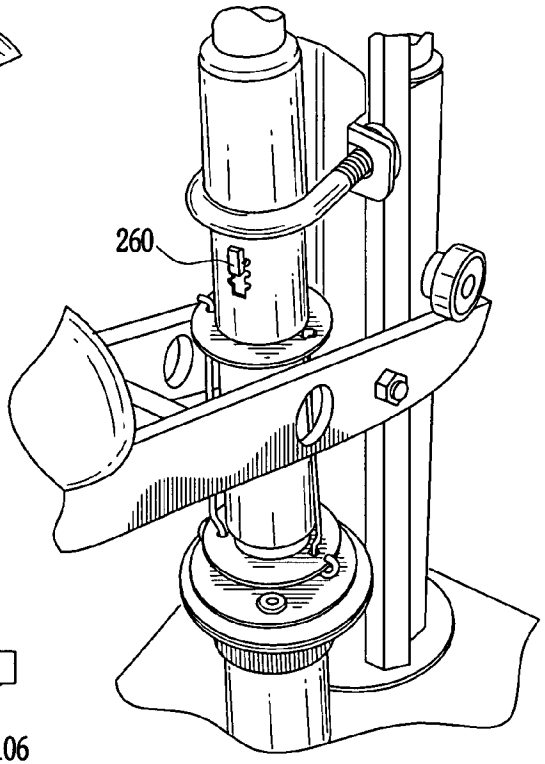
FIG. 7C illustrates an enlargement of a portion of the exemplary embodiment illustrated in FIG. 7A.
Figure 7B:
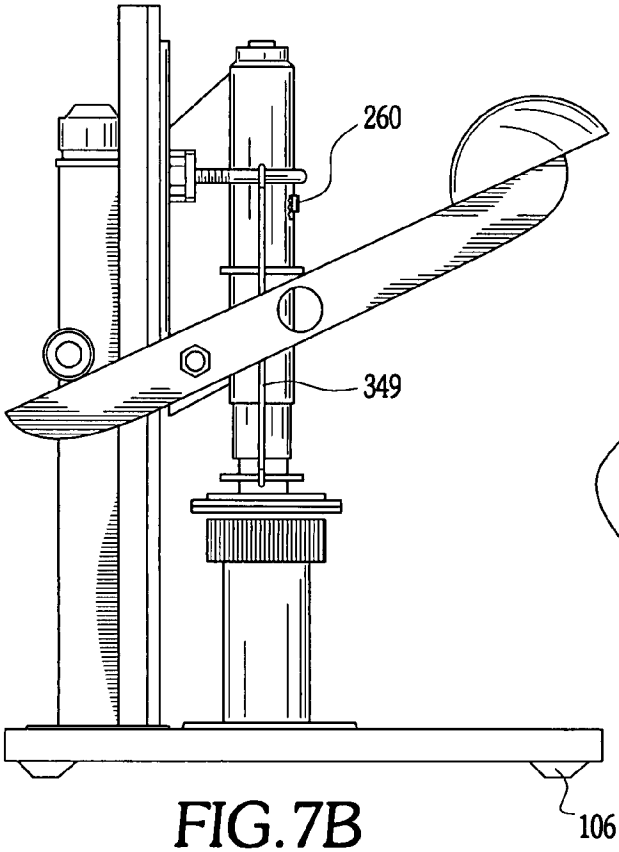
FIG. 7B depicts a side view of the exemplary embodiment illustrated in FIG. 7A.

An exemplary rotation driver mechanism 370 is a Yankee screwdriver or similar mechanism. The rotation driver mechanism 370 as illustrated includes an operation switch 260 for changing the operation of the device between opening and closing. In FIG. 7D, the rotation driver mechanism 370 is depicted as having an outer shaft 372 having a pair of posts 3722 that slide in at least one set of grooves 3742 of a spindle 374; however, the posts 3722 could number one or more. The operation switch 260 controls which set of grooves 3742 the posts 3722 slide in during use of the device. In FIG. 7D, the spindle 374 extends down through the telescoping shaft 343 and is capable of engaging an opening (or recess) 356 in the engagement head 350 with a tip (or end) 376. Once the tip 376 engages, any additional force applied to the outer shaft 372 will cause the posts 3722 to travel along the grooves 3742 and cause the spindle 374 to rotate.

Attached to the rotation driver 370 is a washer 348*a* and on the other side of the washer 348*a* is the telescoping shaft 343. The illustrated telescoping shaft 343 includes an outer shaft and an inner shaft in telescopic engagement with each other, and if the inner and outer shafts are interconnected, then the strands 349 may be omitted. Within the telescoping shaft 343 is a spring 3446 to provide resistance to the compression and provide a delay period during which the lid is unlocked on a child-proof container prior to rotation occurring. At the bottom end of the telescoping shaft 343 is a second washer 348*b*, which would be omitted if no strands 349 are used, connected to the first washer 348*a* through the illustrated strands 349.

Passing through the telescoping shaft 343 and the spring 3446 is the spindle 374 having the tip 376 shaped to engage a reciprocal opening (or recess) 356 in the top surface of the engagement head 350 upon compression of the spring 3446 and contact between the engagement head 350 and the lid 192.

To use the illustrated device, the user places the container 190 and the lid 192 below the engagement head 350 and checks to see if the operation switch 260 is set to the desired operation. The user pushes down on the lever 330 causing the slide mechanism to lower and push the engagement head 350 towards the lid 192. The lever 330 rotates about the connection with the spacer member 3412 while sliding against the rollers 316, which provide a pivot point for the lever 330 and allows it to pull the drive system 340 down. When the engagement head 350 contacts the lid 192 and the spring 3446 has compressed, the lid 292 will be pushed down and disengaged from the container 290. As additional downward vertical movement of the handle 330 occurs, the rotation driver 370 and the spindle 374 translate the vertical movement into rotational movement of the engagement head 350 and thus the lid 192.

FIGS. 8A–8F illustrate another exemplary embodiment of the invention that includes a base 400, a post 410, an arm 420, a handle 430, a drive system 440, and an engagement head 450. The base 400 and the post 410 are similar to the previously described bases 100 and posts 110. The illustrated base 410 is a square shaped base, while the post 410 has a triangular cross-section. The illustrated arm 420 includes an adjustment knob 421, a sleeve (or opening) 422, and a post 424. The adjustment knob 421 allows the user to roughly set the height of the arm 420 and the engagement head 450 to a height level to allow a container 190 with a lid 192 to be placed under the engagement head 450. The adjustment knob 421 engages teeth 4102. The sleeve 422 is in sliding communication with the drive system 440. The post 424 depends from the bottom of the arm and is one anchoring point for spring 426. Illustrated spring 428 that runs from the top of post 410 to arm 420 provides resistance to prevent over-lowering of the arm 420, and as such may be omitted from the device. The handle 430 includes a cam end 436 attached to the arm 420 that lowers the drive system 440 and the engagement head 450 as the handle 430 is pulled down.

The drive system 440 includes a cap (or washer) 447, a spring 4446, a spindle 444, and cam follower 4448. The cap 447 restrains the spring 4446 between it and the arm 420, and the spring 4446 encircles spindle 444. Spindle 444 passes through sleeve 422 and is connected to the cam follower 4448, which is illustrated as a disc shaped member, but could be any shape that allows the cam end 436 of the handle 430 to push on it.

The engagement head 450 preferably includes a bearing (not shown) between it and the cam follower 4448 that allows the engagement head 450 to rotate relative to the cam follower 4448. The engagement head 450 as illustrated includes a platform 456 to support a wedge cam 458. The platform 456 and the wedge cam 458 can take a variety of shapes and forms other than that illustrated while still providing a cam surface for the handle 430 to interact with during use. The wedge cam 458 is pivotally connected to the platform 456 (illustrated connection structure is a pin 4582) such that the wedge cam 458 may be rotated to provide clockwise or counterclockwise rotation to the engagement head 450 as the handle 430 is lowered. The wedge cam 458 provides a cam surface for the handle 430 to move along once the handle 430 contacts the wedge cam 458. The engagement head 450 provides the other connection point for spring 426, which provides resistance to the engagement head 450 rotating and a force to return the engagement head 450 to its starting position after an operation is performed.

Figure 8D:
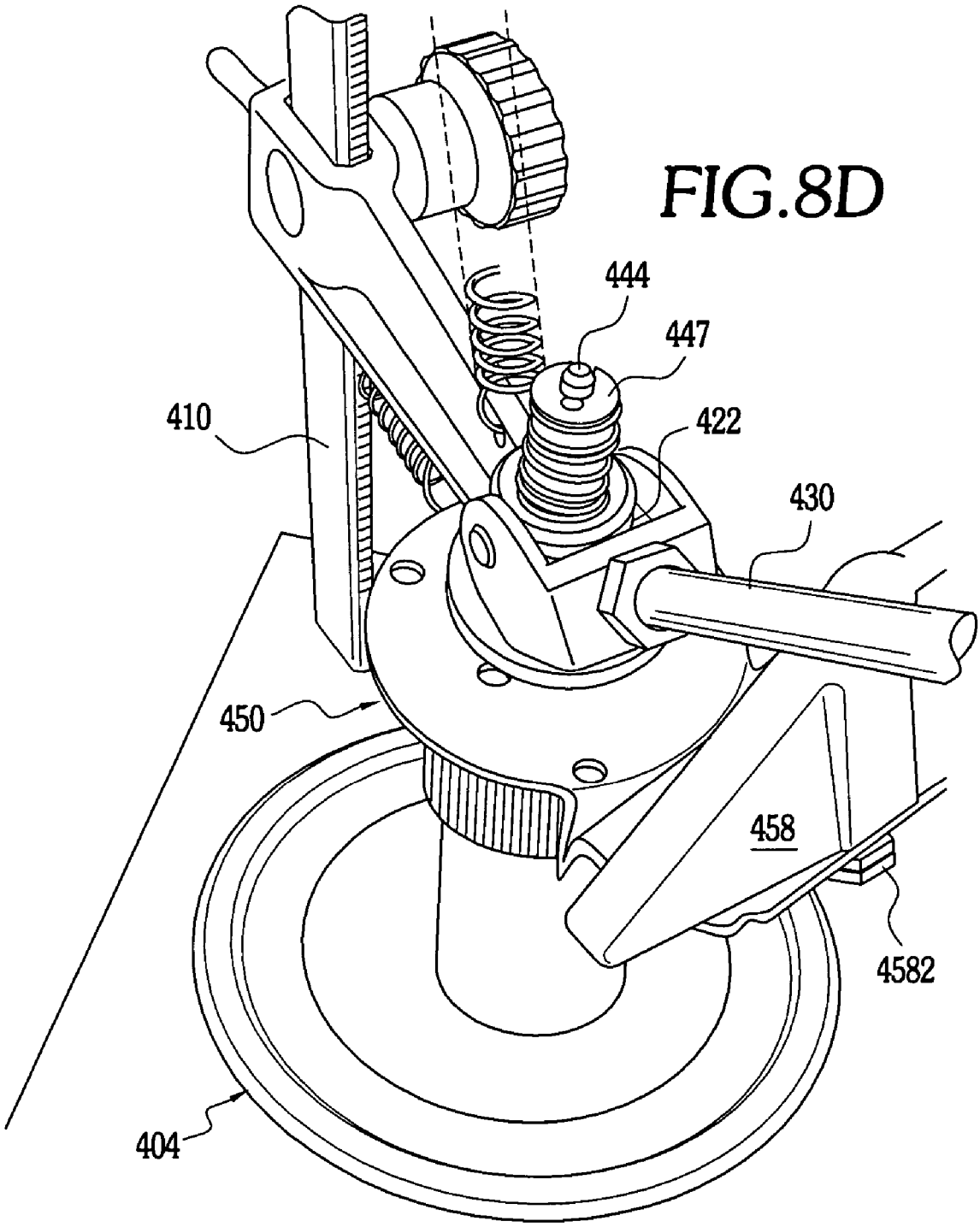
FIGS. 8D–8F illustrate an interaction of components of the exemplary embodiment illustrated in FIGS. 8A–8C.
Figure 8E:
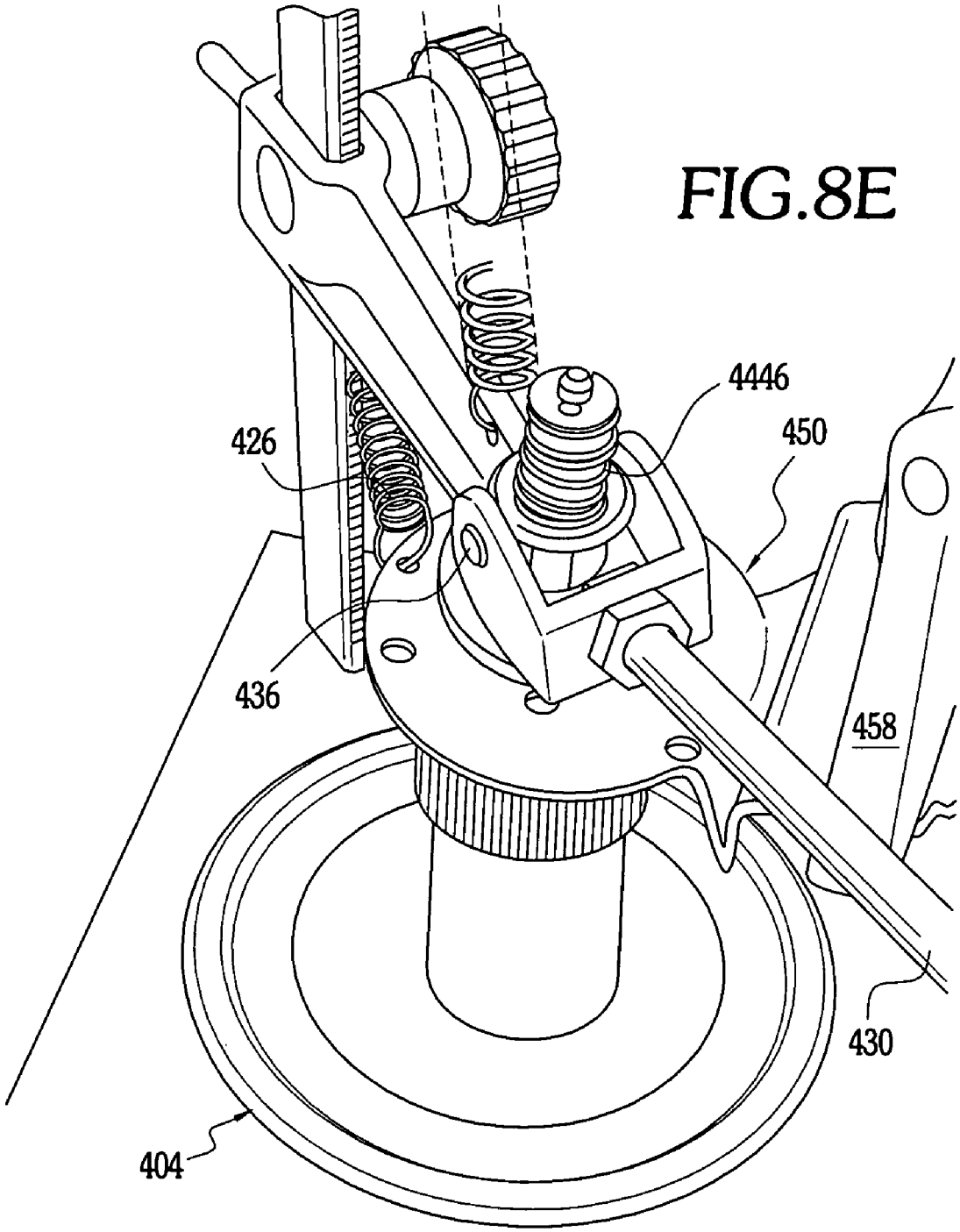
Figure 8F:
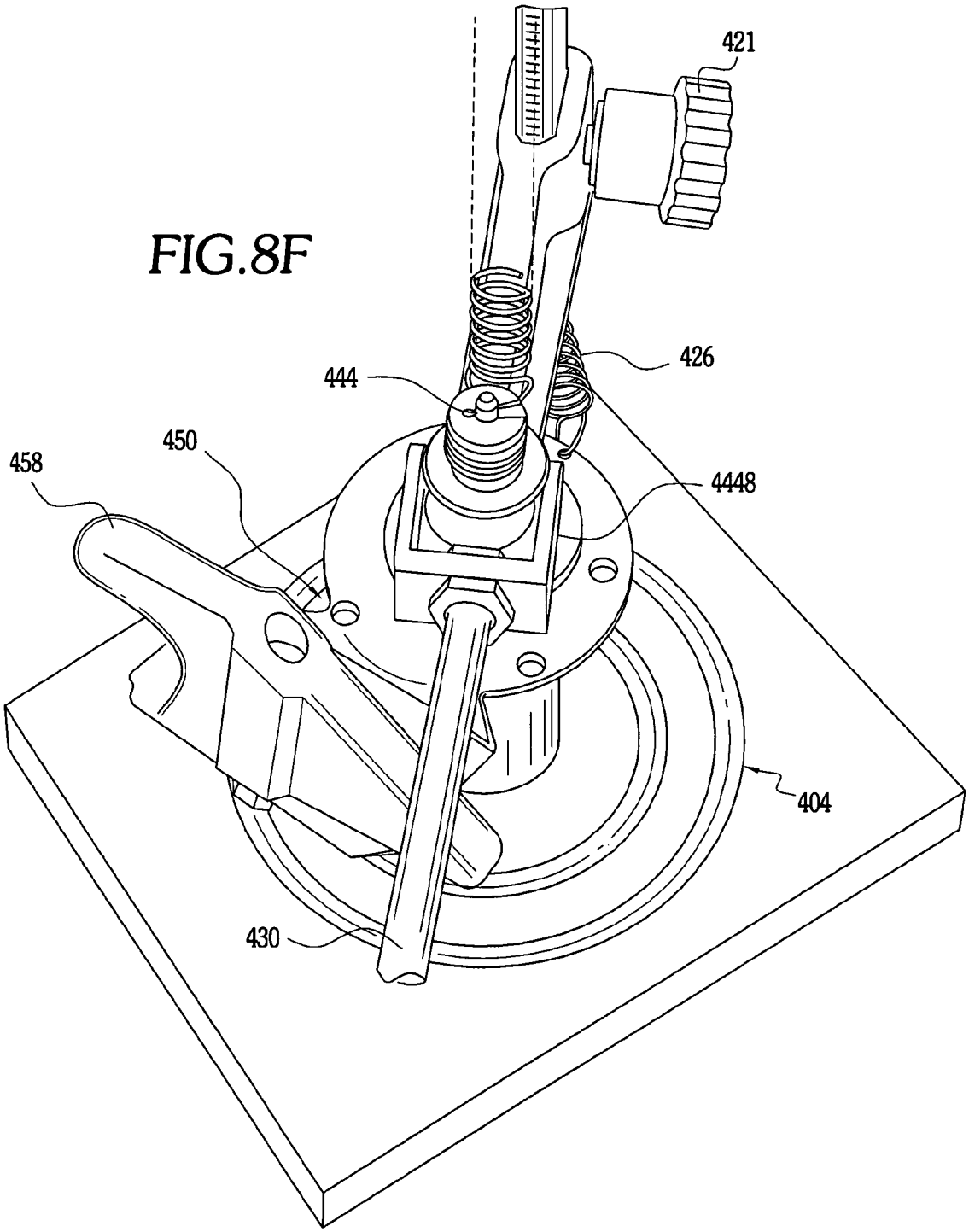

The user positions the wedge cam 458 in the appropriate position to either open (FIGS. 8D and 8E) or close (FIG. 8F) the lid 192 on the container 190, and sets the height of the engagement head 450 in view of the container size. The container 190 with a lid 192 is placed below the engagement head 450. The user pulls the handle 430 down causing the cam end 436 to press against the cam follower 4448 lowering the cam follower 4448 and the engagement head 450 towards the lid 192. Once the handle 430 reaches the wedge cam 458, the handle 430 continues downward while forcing the wedge cam 458 to rotate left or right depending on the direction of the cam follower 4448, which results in the engagement head 450 rotating and opening/closing the lid 192 of the container 190. FIGS. 8D and 8E illustrate the interaction between the handle 430 and the cam wedge 458 for opening the lid. If the user lets go of the handle 430, then the spring 426 unrotates the engagement head 450 and the spring 4446 pulls the cam follower 4448 up which in turn moves the handle 430 back to its starting position.

Figure 9B:
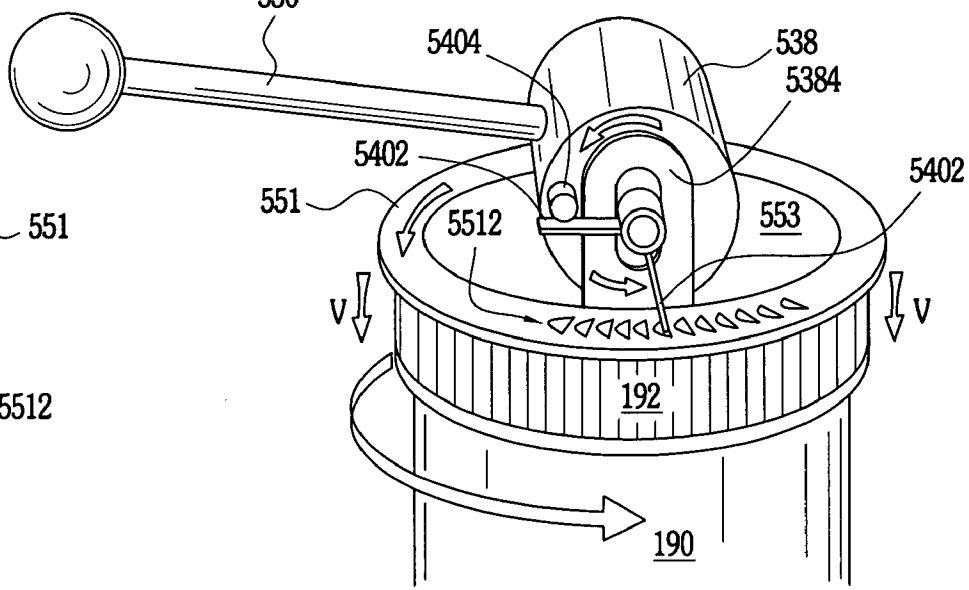
FIG. 9B illustrates the interaction between the exemplary embodiment shown in FIG. 9A and a container with a lid.
Figure 9A:
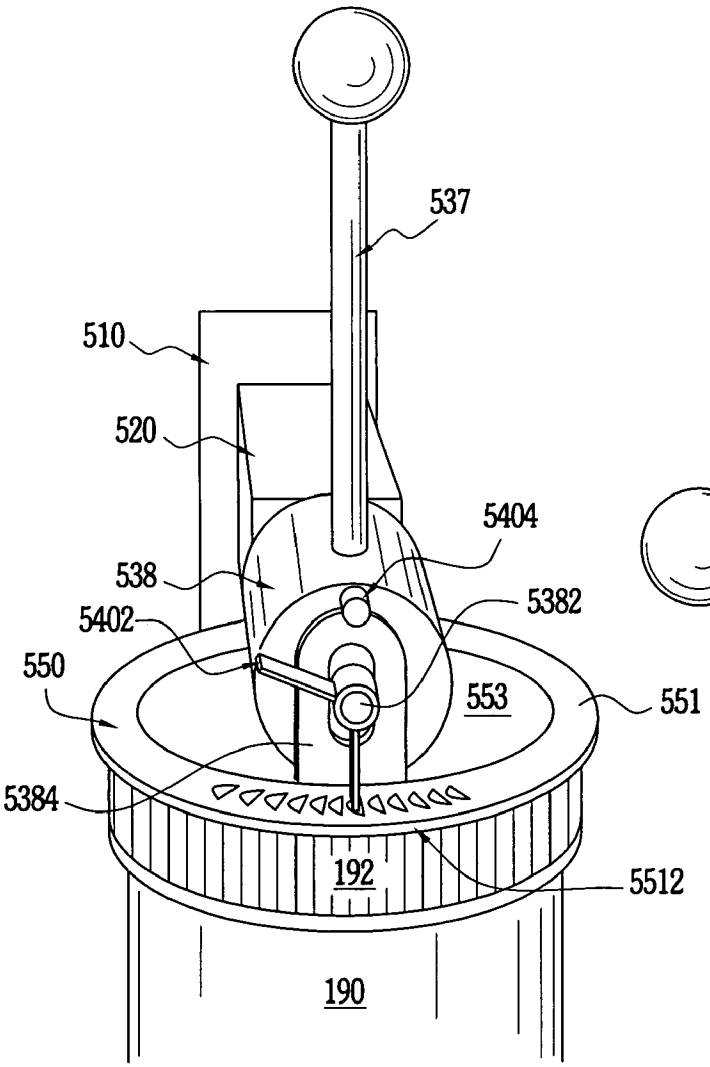
FIG. 9A depicts a side view of a portion of an exemplary embodiment according to the invention.
Figure 10B:
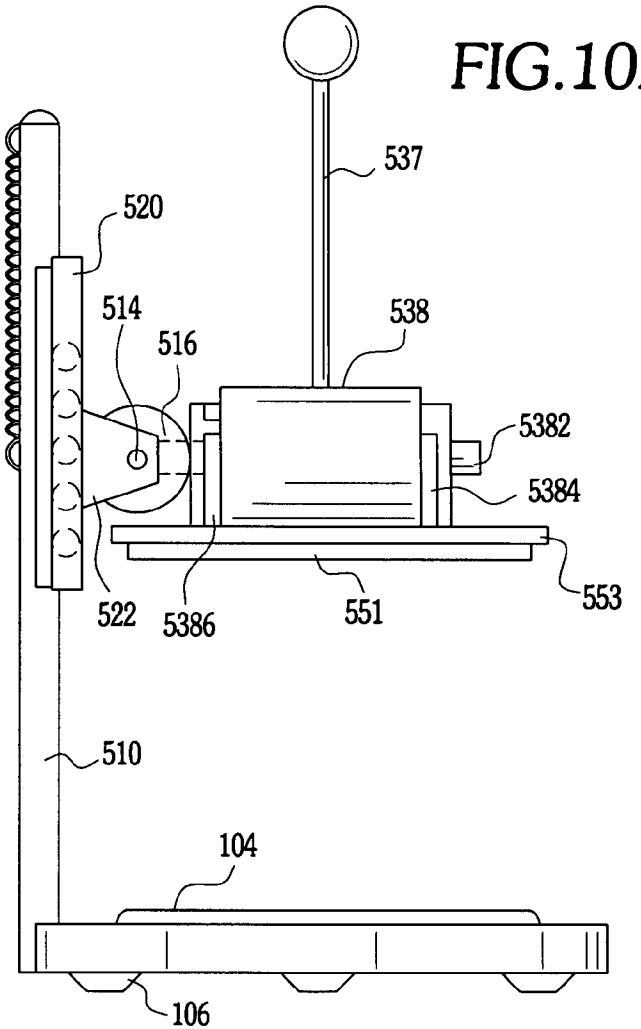
FIG. 10B illustrates the exemplary embodiment illustrated in FIG. 10A with some components removed for clarity.
Figure 10A:
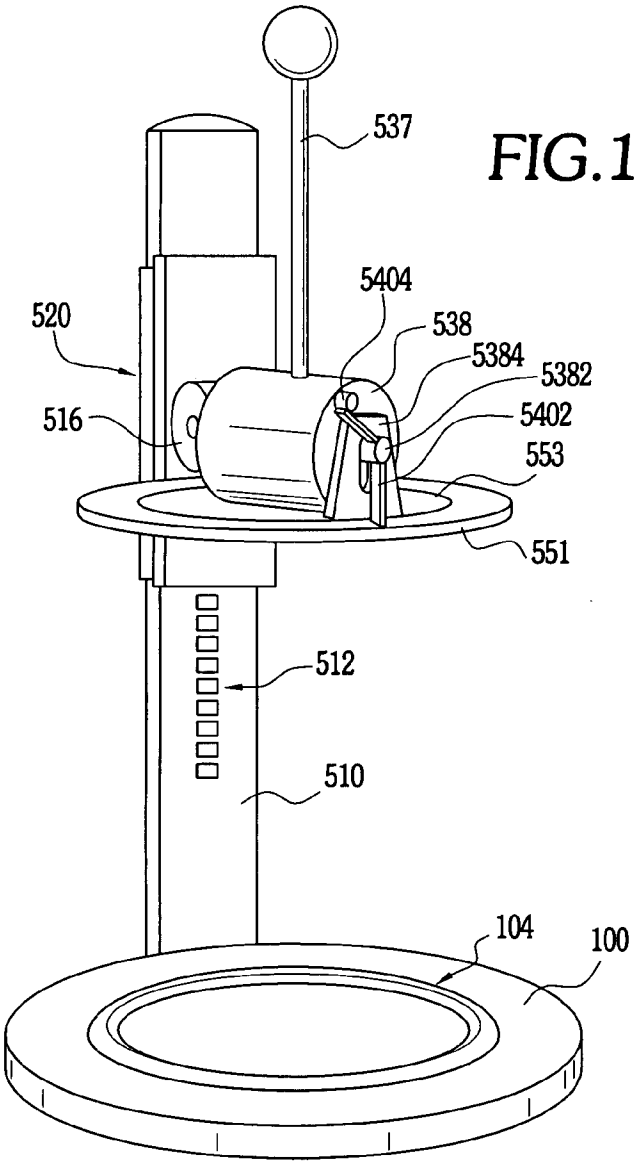
FIG. 10A depicts an exemplary embodiment according to the invention.

FIGS. 9A–10B illustrate two exemplary embodiments of the invention that include a base 100, a post 510, an arm 520, a handle 530, a drive system 540, and an engagement head 550. FIGS. 10A and 10B illustrate the base 100 as circular with concentric circular ridges 104 that assist in placement of a container 190. The post 510 includes a plurality of holes 512 for engagement by the arm 520 that allows the arm 520 to be placed at different heights relative to the post 510. The arm 520 as illustrated in FIGS. 9A and 9B is a member extending from the post 510, and as illustrated in FIGS. 10A and 10B includes a pair of members 522 connected by a spindle 514 of a roller 516, which allows the user to place the container 190 below the engagement head 550 by tilting the engagement head 550 with roller 516. The handle 530 includes an arm 537 connected to a roller 538 having a spindle (or axel) 5382 with one end connected to a bracket 5384 and the other end connected to the arm 520. In FIGS. 10A and 10B, the roller 538 has the axel 5382 pass through a second bracket 5386 before connecting to the roller 516.

The drive system 540, which is not illustrated in FIG. 10B, includes at least a pair of paddles 5402 attached to spindle 5382 which extends through bracket 5384 and a post (or peg) 5404 that extends from the edge of the roller 538. Preferably, the post 5404 is at the top of the roller 538 when the roller 538 is in its starting position, i.e., the post 5404 is aligned with the handle 530. Although not illustrated, there could be two sets of paddles 5402 such that as one paddle disengages the engagement head 550, the next paddle begins (or continues) its engagement of the engagement head 550. The engagement head 550 includes a lazy susan with the top plate 553 connected to the bracket 5384 and the arm 520 in FIGS. 9A and 9B and the second bracket 5386 in FIGS. 10A and 10B. The lazy susan also includes a bottom plate 551 connected to the top plate 553 with a bearing (not shown) between the two plates 551, 553. The bottom plate 551 includes a plurality of grooves 5512 for engagement by at least one of the paddles 5402.

During use of this exemplary embodiment, the user rotates the spindle 5382 to one of two paddle positions based on whether the user wants to open or close the lid 192 of the container 190. The user places the container 190 with the lid 192 below the engagement head 550. The first step is to turn the handle arm 537 in the desired direction to have the peg 5404 push the paddle 5402 closest to the peg 5404 to cause the other paddle 5402 to rotate the bottom plate 551 by applying a force against at least one of the grooves 5512. For example, FIG. 9B illustrates that if the handle 530 is rotated left, the lid 192 is opened by the peg 5404 rotating counterclockwise to push paddle 5402 counterclockwise, which causes the second paddle 5402 to rotate the lower plate 551 counterclockwise as indicated by the arrows. Arrows V illustrate that as the handle 530 is rotated, a vertical force is applied to the lid 192 to disengage it (if necessary) form the container 190.

The various above described levers with accompanying components and with or without one of the exemplary described operation switches are examples of a controlling means for controlling the operation of the device, i.e., the opening and closing of lids on respective containers. The various above described engagement head configurations are examples of a lid contacting means for contacting a lid of a container and rotating the lid. The various described driver means including in at least one embodiment the cam wedge are examples of a rotational means for rotating said lid contacting means in response to use of said controlling means. The various combinations of posts on the bases and the arms are examples of a means for placing the rotational means over the base.

An alternative embodiment would convert the illustrated embodiments into a handheld device where the post would include a handle area below the base.

The exemplary and alternative embodiments described above may be combined in a variety of ways with each other. When there is engagement between two different components, the engagement elements may be reversed between the two components.

As used above "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

Although the present invention has been described in terms of particular embodiments, it is not limited to those embodiments. Alternative embodiments, examples, and modifications which would still be encompassed by the invention may be made by those skilled in the art, particularly in light of the foregoing teachings.

Those skilled in the art will appreciate that various adaptations and modifications of the embodiments described above can be configured without departing from the scope and spirit of the invention. Therefore, it is to be understood that, within the scope of the appended claims, the invention may be practiced other than as specifically described herein.

I claim:

1. A device for loosening and/or tightening a lid on a container, said device comprising:

a base, a post connected to said base, an arm connected to said post, a lever in rotational communication with said arm, a head, an operation switch, and a rotating means for rotating said head based on movement of said lever and the setting of said operation switch to either loosen or tighten a lid on a container.

2. The device according to claim 1, further comprising a gear connected to said lever, and wherein said rotating means includes an outer shaft linear engagement of said gear, an inner shaft in communication with said outer shaft, and a spring in communication with said inner shaft and said head.

3. The device according to claim 2, wherein said inner shaft includes a barrier on an inside of said inner shaft, said barrier is in communication with said spring.

4. The device according to claim 2, wherein said head includes a post extending from a top surface towards said inner shaft.

5. The device according to claim 2, wherein said head includes a plurality of teeth, and said inner shaft includes a plurality of teeth around a free end capable of engaging said plurality of teeth of said head.

6. The device according to claim 2, wherein said head includes a shaft extending from a top surface of said head, said shaft includes a plurality of teeth spaced around a top of said shaft, and said inner shaft includes a plurality of teeth around a free end capable of engaging said plurality of teeth of said shaft of said head.

7. The device according to claim 6, wherein said shaft of said head overlaps with said outer shaft.

8. The device according to claim 2, wherein said outer shaft includes a pair of slots on opposing sides of said outer shaft, and said inner shaft includes at least one pin in communication with said slots.

9. The device according to claim 8, wherein each of said slots is V-shaped.

10. The device according to claim 2, wherein said inner shaft includes a pair of slots on opposing sides of said inner shaft, and said outer shaft includes at least one pin in communication with said slots.

11. The device according to claim 2, wherein said head includes a recess, and said inner shaft includes a tip capable of engaging the recess of said head.

12. The device according to claim 1, further comprising a gear connected to said lever and in communication with said rotating means.

13. The device according to claim 1, wherein said rotating means includes a rotation driver mechanism connected to said arm and capable of engaging said head, a telescoping shaft in communication with said rotational driver mechanism, and a spring housed within said telescoping shaft.

14. The device according to claim 13, wherein said rotation driver mechanism includes an outer shaft, and a spindle with at least one spiral channel engaging said outer shaft.

15. A device for loosening and/or tightening a lid on a container, said device comprising:

a base, a post connected to said base, an arm connected to said post, a lever in rotational communication with said arm, said lever includes a handle, a roller having a spindle connected to said handle and said arm, said head includes a top plate connected to said roller, a bottom plate, said bottom plate having a plurality of recesses spaced around a perimeter of said bottom plate and a bottom surface capable of contacting a lid of a container, and a bearing between said top plate and said bottom plate, a head, and a rotating means for rotating said head based on movement of said lever, said rotating means includes at least two paddles extending from said spindle and spaced from each other, each of said paddles is capable of engaging at least one recess in said bottom plate, and a post on an end of said roller, said post is capable of pushing at least one paddle.

16. A device for loosening and/or tightening a lid on a container, said device comprising:

a base, a post connected to said base, an arm connected to said post, said arm includes a passageway passing therethrough, a lever in rotational communication with said arm, said lever includes a handle, and a cam end connected to said handle and said arm, a head, and a rotating means for rotating said head based on movement of said lever, said rotating means includes a spindle passing through the passageway of said arm, a spring encircling a portion of said spindle above said arm, a cam follower attached to said spindle at a point below said arm, said cam follower in communication with said cam end of said lever, and a cam wedge connected to said head, said cam wedge capable of causing said head to rotate as said handle traverses said cam wedge.

17. The device according to claim 16, further comprising a return spring attached to said head, and wherein said arm further includes a post attached to said return spring.

18. A device for loosening and/or tightening a lid onto a container, said device comprising:

a base, a post connected to said base, an arm connected to said post, said arm including a sleeve, a lever in rotational communication with said arm, a gear connected to said lever and housed within said arm, an outer shaft including a rack engaging said gear and journaled with said sleeve, an inner shaft connected to said outer shaft, said inner shaft including a barrier internal to said inner shaft, and a plurality of teeth around a bottom of said inner shaft, a spring in communication with said barrier and internal to said inner shaft, and a head in communication with said spring, said head having a top surface, a plurality of teeth spaced from each other and extending from said top surface capable of engaging said plurality of teeth of said inner shaft, a post extending up from said top surface from a point within said plurality of teeth, said post encircled by said spring, and a bottom surface opposing said top surface.

19. The device according to claim 18, further comprising a operation switch in communication with at least one of said inner shaft and said outer shaft, and wherein said barrier having an opening passing therethrough, said head includes a shaft extending from said top surface on which said plurality of teeth are present, said post of said head includes a cap at its free end, said post passes through the opening in said barrier and said cap rests on said barrier when said spring is uncompressed, one of said inner shaft and said outer shaft includes a pair of slots with the other shaft having at least one pin in sliding engagement of at least of said slots.

20. A device for loosening and/or tightening a lid on a container, said device comprising:

a base with at least one protrusion having a circular shape, a controlling means for controlling the operation of said device to either loosen or tighten a lid on a container, a lid contacting means for contacting a lid of a container and rotating the lid, a rotational means for rotating said lid contacting means in response to use of said controlling means, a means for placing said rotational means over said base.

* * * * *